United States Patent [19]

Moreton

[11] 3,938,784

[45] Feb. 17, 1976

[54] BLENDER

[75] Inventor: George C. Moreton, Winston-Salem, N.C.

[73] Assignee: Electronic Data Controls Corporation, Winston-Salem, N.C.

[22] Filed: Aug. 24, 1973

[21] Appl. No.: 391,466

[52] U.S. Cl. ..... 259/8; 259/9; 259/96

[51] Int. Cl.[2] ..... B01F 7/04; B01F 7/18

[58] Field of Search ..... 259/6, 7, 8, 9, 10, 43, 259/44, 65, 66, 67, 68, 69, 169, 96

[56] References Cited

UNITED STATES PATENTS

| | | | |
|---|---|---|---|
| 2,738,930 | 3/1956 | Schneider | 259/8 X |
| 3,012,763 | 12/1961 | Martin | 259/9 X |
| 3,335,911 | 8/1967 | Stutz | 259/43 X |
| 3,627,280 | 12/1971 | Fridman | 259/8 X |

*Primary Examiner*—Harvey C. Hornsby
*Assistant Examiner*—Alan Cantor
*Attorney, Agent, or Firm*—Richards, Shefte & Pinckney

[57] ABSTRACT

A blender for mixing beverages that has a cylindrical upright, substantially closed, frustoconically bottomed blending bowl with an intake port at the top and a discharge port at the outer edge of the bottom of the bowl. A motor driven impeller is mounted for rotation about a longitudinal axis in the bowl and has blades projecting radially therefrom for coaction with stationary blades that extend inwardly from the bowl wall. One stationary blade is located just past the discharge port in the direction of impeller rotation to force the contents out the discharge port, which is located within the longitudinal extent of the stationary blades for this purpose. The impeller blades have edges complementary to the stationary blade edges and inclined with respect thereto and in a direction to direct the contents longitudinally toward the discharge port, for which latter purpose the impeller blades have bottom edges that are complementary to the sloping bottom wall.

In an alternative embodiment, the blending bowl and impeller are horizontally disposed with the intake port at the rear end and the discharge port at the bottom of the front end, and the bowl being forwardly radially enlarged to facilitate advancement of its contents. The intake port is laterally offset in the direction of impeller rotation and a radially inwardly extending baffle plate is provided laterally opposite the inlet. The impeller blades are triangularly shaped and the stationary blades are complementarily triangularly shaped with one stationary blade just past the discharge port in the direction of impeller rotation.

22 Claims, 8 Drawing Figures

BLENDER

BACKGROUND OF THE INVENTION

This invention relates to blenders for mixing liquids, liquids and powders, or similar products. More particularly, it pertains to beverage blenders in which a dry powder, for example, is mixed with a liquid such as water to produce a potable beverage.

Beverage blenders of this general type are commonly included in vending machines of the type that dispense soft drinks, coffee, cocoa, and other beverages so that a relatively small volume of dry powder supply can be used with tap water to provide a large number of drinks without frequent replenishing and without a large liquid reservoir, but at the same time it is of course important that the blending be accomplished rapidly and automatically to satisfy customer demands.

A typical prior art example of a blender of this type is disclosed in Joschko U.S. Pat. No. 3,168,292, issued Feb. 2, 1965, for a Beverage Mixing Device. That device has a horizontally disposed cylindrical casing mounted on a panel, and has a laterally offset inlet port located generally adjacent the top of one end of the casing and an outlet port located at the bottom of the other end. An impeller rotates on a longitudinal axis within the casing and has axially aligned blades that have a greater radial extent at the inlet end of the casing than at the outlet end, which is said to produce enhanced mixing near the inlet and smooth flow at the outlet.

The present invention represents a substantial advance over the prior art and particularly over the blender of the Joschko patent as it provides faster, more uniform blending and rapid discharge.

SUMMARY OF THE INVENTION

Briefly described, the blender of the present invention is comprised of a substantially closed blending bowl having spaced intake and discharge ports, stationary blades, an impeller, and means for rotating the impeller. The impeller is mounted in the bowl for rotation about a longitudinal axis and has radially extending blades disposed intermediate the intake and discharge ports. The stationary blades extend longitudinally and radially inwardly from the bowl into close proximity to the impeller blades for cooperation with them for enhanced mixing. One of the stationary blades is disposed adjacent the discharge port in the direction of impeller rotation to facilitate discharge through the discharge port.

In the preferred embodiment, the blending bowl is disposed vertically and has a bottom wall which slopes downwardly and towards the discharge port to facilitate discharge. The impeller and stationary blades may have complementary adjacent edges to provide a shearing action for enhanced mixing and the impeller blades may also be inclined to direct the contents of the blending bowl longitudinally toward the discharge port and to provide enhanced shearing coaction with the stationary blades.

In an alternate embodiment, the blending bowl is disposed horizontally with the intake port located adjacent the rear end of the bowl and the discharge port located adjacent the bottom of its forward end, and blending bowl may be forwardly radially enlarged to facilitate advancement of its contents. The intake port may be laterally offset in the direction of impeller rotation, and a baffle plate extending radially inwardly from the bowl may be located laterally opposite the intake port to confine the contents of the bowl and facilitate longitudinal advancement to the discharge port.

The present invention also is directed to a blender embodying a generally vertically disposed bowl that has a bottom wall adjacent a discharge port, with the bottom wall sloping outwardly toward the discharge port to facilitate discharge as a vertically disposed impeller rotates in the bowl.

DESCRIPTION OF THE PREFERRED EMBODIMENTS

The blender 10 of the preferred embodiment of the present invention is designed for use in a beverage dispensing machine of the type in which a dry powder product and a liquid, such as water, are blended to form a soft drink, coffee, cocoa, or some other beverage that is dispensed in a measured quantity.

Figure 5:
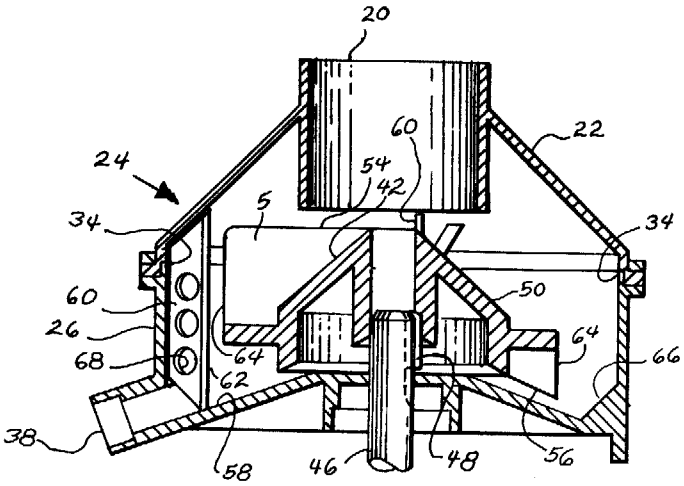
FIG. 5 is a vertical section taken along line 5—5 of FIG. 3.
Figure 3:
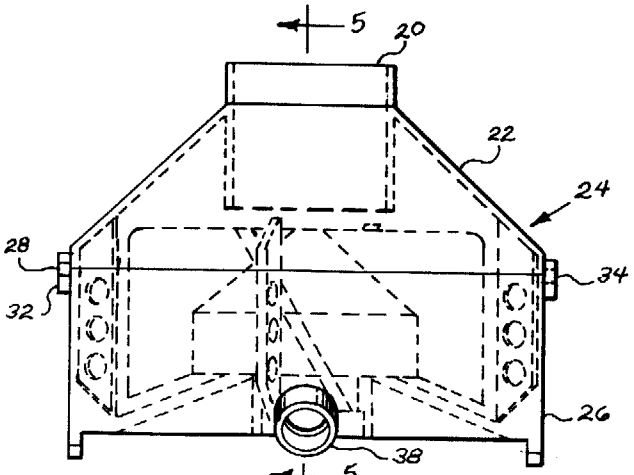
FIG. 3 is a front elevation of the blending bowl and impeller of the blender of FIG. 1.

The blender 10 is generally vertically disposed for receipt of a measured amount of dry product from a feed tube 12 opening centrally above a funnel-shaped upper portion 14 of the blender 10, with a measured quantity of liquid being fed through a conduit 16 tangentially into the funnel-shaped upper portion 14 for swirling of the liquid in a manner that clears any dry product from the upper portion 14 and also enhances the blending action described hereinafter. The funnel-shaped upper portion 14 has a bottom opening 18 of sufficient size to allow the dry product and liquid to flow freely therethrough into and through an intake port 20 in the dome 22 of a blending bowl 24 disposed therebelow. As seen in FIGS. 3 and 5, the intake port 20 extends cylindrically into the bowl 24 to control product flow into the center of the bowl and to minimize back splashing therefrom.

The funnel-shaped upper portion 14 is supported on the blending bowl dome 22 with the bottom opening 18 of the upper portion 14 seated in the intake port 20 of the dome 22, and the dome enlarges downwardly to the same direction as a cylindrical base 26 of the blending bowl 24 on which the dome 22 is mounted by engagement of radially protruding flanges 28 on the dome 22 in slots 30 formed in mating lug projections 32 on the base 26. The dome 22 and base 26 are complementarily recessed annularly as indicated at 34 for retention of the dome 22 on the base 26 against lateral movement while the engagement of the flanges 28 and lug projections 32 prevent vertical separation of these parts. The base 26 in turn is fixed to a horizontal platform 36 of a dispensing machine (not shown), adjacent to which platform 36 a discharge port 38 is formed at the bottom outer edge of the base 26 for discharge of blended beverage from the discharge port 38 through a spout 40 into a cup or other receptacle (not shown). With this arrangement the blending bowl 24 is substantially closed, with the intake port 20 being adjacent one end of the bowl and the discharge port 38 adjacent the other end.

The dry mix and liquid are blended within the bowl 24 by the action of an impeller 42 that is mounted for rotation about a vertical axis coaxial with the axis of the blender 10. This impeller is driven by an electric motor 44 mounted on the bottom of the dispenser platform 36 and has a drive shaft 46 extending upwardly through the platform 36 coaxially into the blending bowl 24 for drivingly mounting thereon of the impeller 42, which is secured for rotation therewith by a key plate 48.

The impeller 42 has a hub 50 that tapers downwardly and outwardly in a frustoconical configuration to an enlarged cylindrical configuration and has four radially projecting blades 52 that are disposed intermediate the intake and discharge ports 20, 38 for blending of the bowl contents in the space therebetween, and that are inclined downwardly from upper leading edges 54 to bottom trailing edges 56, with this blade inclination being related to the direction of impeller rotation to direct the contents of the blending bowl 24 longitudinally downward toward the discharge port 38. The frustoconical shape of the hub 50 and the centrifugal force imparted by the rotating impeller blades 52 directs the contents radially outward toward the discharge port 38, which outward direction is enhanced by the shape of the bottom wall 58 of the blending bowl base 26, which slopes downwardly and outwardly in a frustoconical configuration toward the level of the discharge port 38, which, as seen in FIG. 5, is in effect a continuation of the adjacent portion of the bottom wall 58 of the blending bowl base 26. To enhance the mixing action and to assure substantially complete discharge of the contents from the blending bowl 24 through the discharge port 38, the trailing edges 56 of the impeller blades 52 extend downwardly and outwardly to provide a configuration complementary to the frustoconical configuration of the bottom wall 58 of the blending bowl base 26.

The impeller blades 52 terminate radially at a relatively short spacing from the cylindrical wall of the blending bowl base 26, in which space are disposed four vertically extended stationary blades 60, each of which is secured to the blending bowl dome 22 and extends downwardly into the blending bowl base 26 along the cylindrical wall thereof. The inner vertical edges 62 of the stationary blades 60 are disposed in close proximity to and complementary with the adjacent outer edges 64 of the impeller blades 42 for shearing coaction therewith in blending the contents of the bowl 24, with the aforementioned inclination of the impeller blades 52 enhancing such shearing coaction.

The stationary blades 60 extend downwardly into contact with the bottom wall 58 of the blending bowl base 26, which has a short upwardly and outwardly sloping outer portion 66 that connects the main frustoconical surface with the cylindrical wall and is of generally the same radial extent as the bottom edge of the stationary blades 60. The aforementioned discharge port 38 opens into this outer portion 66 and is, therefore, disposed within the longitudinal extent of the stationary blades 60.

Figure 1:
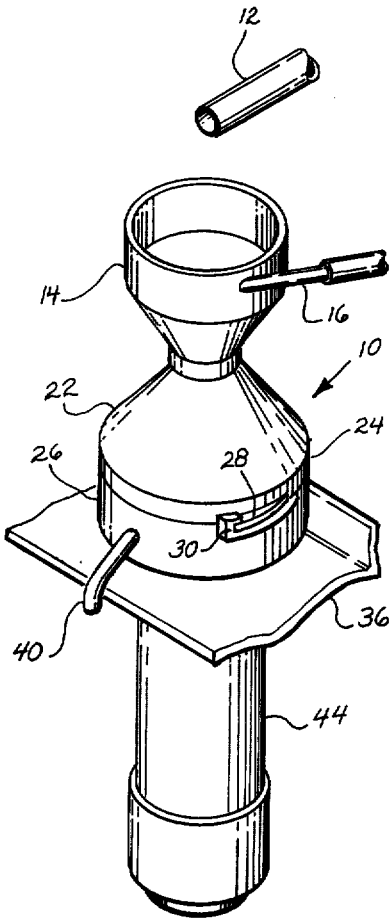
FIG. 1 is a perspective view of a blender according to the preferred embodiment of the present invention.
Figure 2:
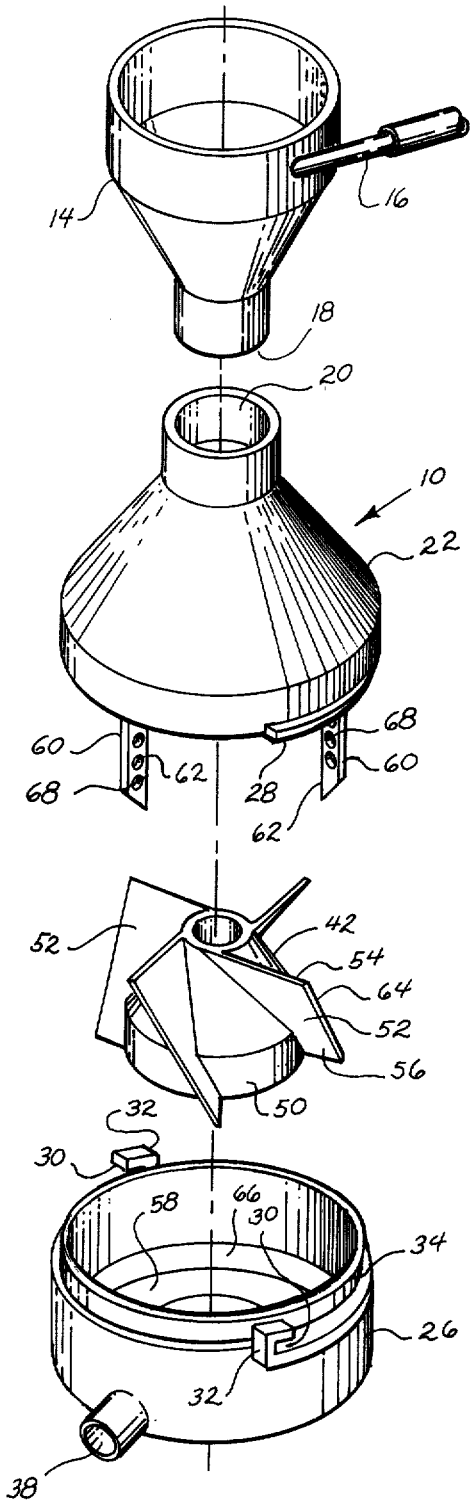
FIG. 2 is an exploded perspective view of the blender of FIG. 1.
Figure 4:
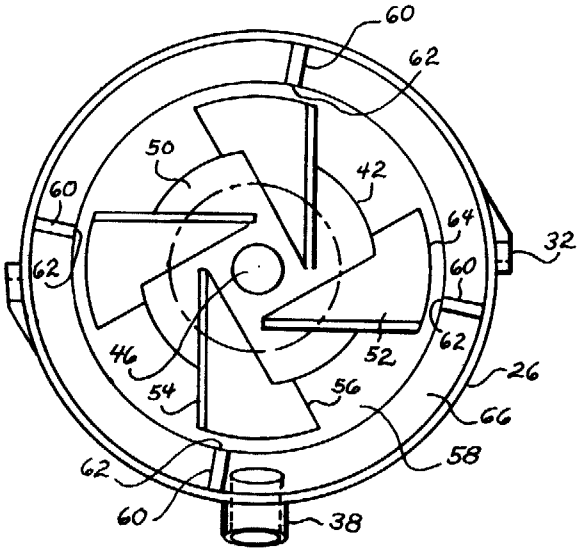
FIG. 4 is a plan view of the bowl and impeller of FIG. 3 with the top of the bowl removed.

The stationary blades 60 not only enhance the blending action in cooperation with the impeller blades 52, but one of the stationary blades 60 is located immediately adjacent the discharge port 38 in the direction of impeller rotation, as seen in FIGS. 3, 4 and 5, to facilitate discharge of the contents of the blender through the discharge port 38 by restricting circular flow of the contents, thereby building pressure at the discharge port that causes discharge of the contents through the port. Without disposition of this stationary blade just past the discharge port the contents of the blender would be less imposed toward the discharge port and would, therefore, require a greater length of time to complete emptying of the blender. Thus, this stationary blade location, in cooperation with the downwardly and outwardly sloping bottom wall 58 and the downwardly inclined impeller blades 52 results in a rapid discharge of the contents from the blender, which is of particular importance in a beverage dispensing machine because of the reduced power requirements and particularly because of the reduced time necessary to deliver a beverage to the user of the machine. The resulting faster cycling of the machine also allows more drinks to be dispensed in a given period of time for the benefit of the owner or operator of the machine.

Of course, to have a short cycle or blending period, it is necessary that a full blending action can be accomplished in the cycle time. This is obtained in the blender of the present invention by the combination of stationary and impeller blades and the shearing coaction of the edges as described hereinabove. The blending is also enhanced by providing apertures 68 in the stationary blades 60. All of these factors also contribute to the creation of substantial turbulence not only to accomplish rapid blending but also importantly to produce substantial aeration for taste qualities and for economy of cost per drink.

In an alternate form of the present invention, a generally horizontally disposed blender 70 is utilized, having a substantially closed blending bowl 72 that enlarges radially from a rear end adjacent which a downwardly opening intake port 74 is located to a forward end adjacent the bottom of which a discharge port 76 is located. The rear end of the blending bowl 72 extends cylindrically for mounting in the frame of a beverage dispensing machine and has an end flange 78 for locking to a machine frame. The shaft 80 of a drive motor (not shown) extends through the rear end of the blending bowl 72 and carries a key plate 82 that locks the shaft 80 in the hub 84 of an impeller 86 disposed coaxially within the blending bowl 72 for rotation by the shaft 80.

The impeller 86 has four radially projecting blades 88 disposed intermediate the intake port 74 and the discharge port 76 for blending of dry product and liquid received through the intake port 74 and advancing longitudinally through the blending bowl 72 and ultimately through the discharge port 76.

Figure 6:
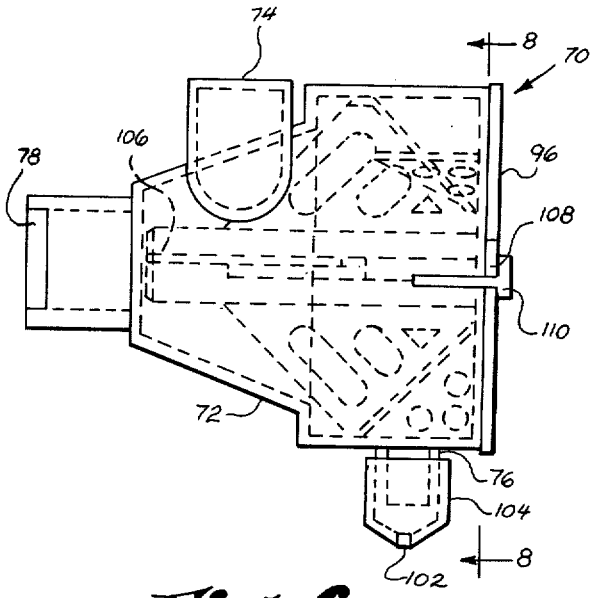
FIG. 6 is a side elevational view of an alternative embodiment of the blender of the present invention.
Figure 8:
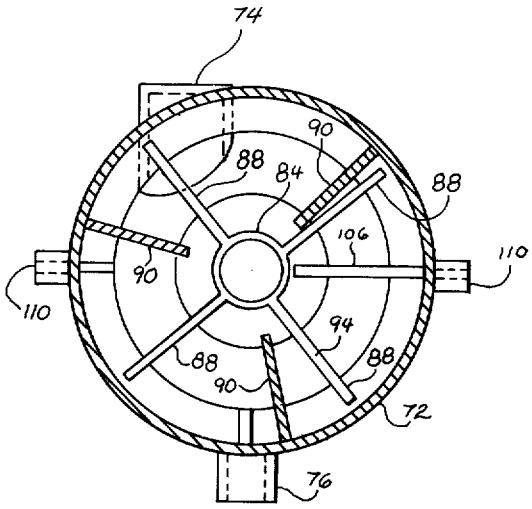
FIG. 8 is a vertical section taken along line 8—8 of FIG. 6.
Figure 7:
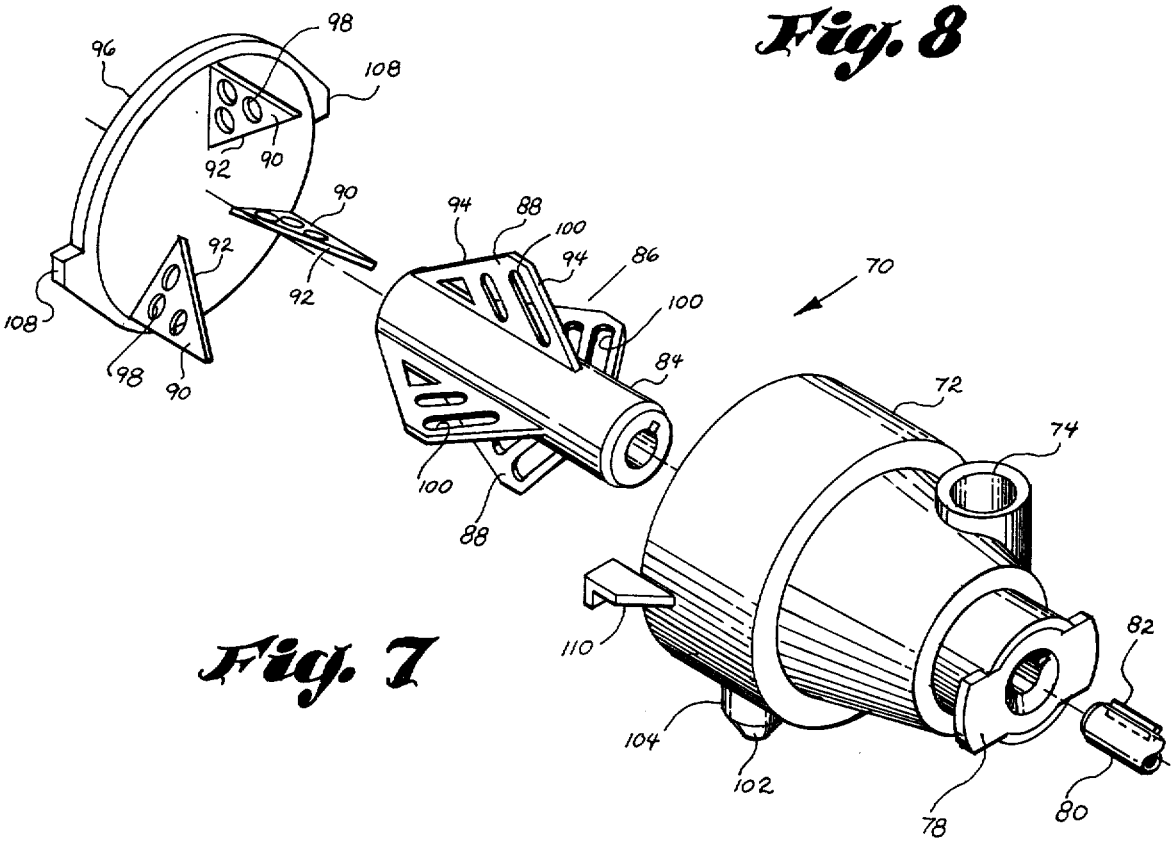
FIG. 7 is an exploded perspective view of the blender of FIG. 6.

As in the case of the embodiment of FIGS. 1–5, the impeller blades 88 operate in cooperation with stationary blades 90 mounted in the blending bowl 72 and projecting radially therein with inner edges 92 in close proximity to and shaped complementary with the outer edges 94 of the impeller blades 88. These complementary edges 92, 94 taper from relatively near the base of the impeller blades 88 at the forward end of the blending bowl 72 to adjacent the cylindrical wall of the bowl intermediate the ends thereof. Thus, as seen in FIGS. 6 and 7, the impeller blades 88 are triangular with one side thereof being the inner edge secured to the impeller hub 84 and the other sides converging to an apex closely adjacent the blending bowl wall, and the stationary blades 90 are triangularly shaped with an inclined base side forming the aforementioned inner edge 92 adjacent the impeller blade 88 and the other triangular sides extending longitudinally at the blending bowl wall and radially along an end cap 96 forming the forward end of the blending bowl 72. These stationary blades 90 are secured to the end cap 96 and extend therefrom into the blending bowl 72 so that the discharge port 76 is disposed within the longitudinal extent of the stationary blades 90. As in the case of the embodiment of FIGS. 1–5, these stationary blades 90 are formed with apertures 98, and in this embodiment the impeller blades 88 are also formed with apertures 100 for enhanced turbulence and shearing action.

Also as in the embodiment of FIGS. 1–5 one of the stationary blades 90 is disposed closely adjacent the discharge port 76 in the direction of impeller rotation to facilitate discharge of the blended contents of the bowl 72, with the discharge also being controlled by the size of the opening 102 in the discharge adapter 104 that is disposed exteriorly over the discharge port 76. This adapter 104 may be changed to use adapters with different size openings for more rapid or slower discharge depending upon the blending cycle required for the particular material being blended.

The discharge port 76 is located at the bottom of the forward end of the blending bowl 72 and the intake port 74 is disposed near the top of the rear of the bowl 72, but laterally offset in the direction of impeller rotation so that the product and liquid introduced through the intake port 74 will be directed downwardly rather than upwardly or partially upwardly were the intake port 74 located centrally or to the opposite side. Also to retain the contents against upward movement and thereby to facilitate longitudinal advance, a baffle plate 106 is secured to the wall of the blending bowl 72 and extends radially inwardly therefrom laterally opposite the intake port 74. This baffle plate 106 is shaped to cooperate with but not to interfere with the operation of the impeller blades 88.

The aforementioned end cap 96 is secured to the forward end of the blending bowl 72 by radial projections 108 on the end cap 96 that engage hook-shaped flanges 110 extending from the blending bowl 72 longitudinally over the radial projections 108. This projection-flange connection prevents longitudinal separation of the end cap 96 and blending bowl 72, and the stationary blades 90, which are fixed to the end cap 96, prevent lateral relative movement of the end cap 96 and blending bowl 72.

From the foregoing descriptions, it will be apparent that fast uniform blending and rapid discharge are produced by the various embodiments of the present invention, which is not intended to be limited by the detailed description and illustrations herein, but is intended to be capable of variation within the scope of the invention and is not to be limited by this disclosure or otherwise except as defined in the appended claims.

I claim:

1. A blender for mixing liquids, liquids and powders, or similar products, said blender comprising a substantially closed blending bowl having spaced intake and discharge ports, an impeller mounted in said bowl for rotation about a longitudinal axis and having radially extending blades disposed intermediate said intake and discharge ports, means for rotating said impeller, and longitudinally extending stationary blades extending radially inwardly from said bowl into close proximity to said impeller blades for cooperation therewith, one of said stationary blades being disposed adjacent said discharge port and past said port in the direction said impeller advances product, said one blade thereby obstructing advance of the product past said discharge port to facilitate discharge of product through said discharge port.

2. A blender according to claim 1 and characterized further in that said stationary and impeller blades have complementary adjacent edges.

3. A blender according to claim 2 and characterized further in that said impeller has a base from which said blades extend radially, and said complementary edges of said stationary and impeller blades taper radially outwardly from relatively near said base of said impeller blades at one end of said bowl to adjacent the wall of said bowl intermediate the ends thereof.

4. A blender according to claim 2 and characterized further in that said impeller blades are inclined with respect to said stationary blades to provide enhanced shearing coaction therewith.

5. A blender according to claim 4 and characterized further in that said impeller blades are inclined forwardly in the direction of impeller rotation from said discharge port toward said intake port, thereby directing the contents of said blending bowl longitudinally toward said discharge port.

6. A blender according to claim 1 and characterized further in that said discharge port is disposed within the longitudinal extent of said stationary blades.

7. A blender according to claim 1 and characterized further in that said stationary blades have apertures therethrough for enhanced mixing action.

8. A blender according to claim 7 and characterized further in that said impeller blades have apertures therethrough for enhanced mixing action.

9. A blender according to claim 1 and characterized further in that said blending bowl is disposed vertically with said intake port adjacent the top thereof and said discharge port adjacent the bottom thereof.

10. A blender according to claim 9 and characterized further in that said impeller blades are inclined forwardly in the direction of impeller rotation from said discharge port upwardly toward said intake port, thereby directing the contents of said blending bowl downwardly toward said discharge port.

11. A blender according to claim 9 and characterized further in that the bottom wall of said blending bowl slopes downwardly and outwardly toward said discharge port.

12. A blender according to claim 11 and characterized further in that said impeller blades have bottom edges extending in a configuration complementary to said sloping bottom wall of said blending bowl.

13. A blender according to claim 11 and characterized further in that said discharge port is located at the outer edge of said sloping bottom wall.

14. A blender according to claim 13 and characterized further in that said sloping bottom wall is frustoconically shaped.

15. A blender according to claim 1 and characterized further in that said blending bowl is disposed horizontally with said intake port located adjacent the rear end thereof and said discharge port located adjacent the bottom of the forward end thereof.

16. A blender according to claim 15 and characterized further in that said blending bowl is forwardly radially enlarged to facilitate advancement of the contents thereof.

17. A blender according to claim 15 and characterized further in that said intake port is laterally offset in the direction of impeller rotation.

18. A blender according to claim 17 and characterized further by a baffle plate extending radially inwardly from said blending bowl and laterally opposite said intake port to confine the contents of said blending bowl to facilitate longitudinal advancement thereof.

19. A blender for mixing liquids, liquids and powders, or similar products, said blender comprising a substantially closed blending bowl generally vertically disposed and having a bottom wall, an intake port adjacent one end of said bowl and a discharge port adjacent the other end thereof, said discharge port being disposed adjacent the outer edge of said bottom wall and said bottom wall sloping downwardly toward said outer edge thereof, an impeller mounted in said bowl for rotation about a generally vertical longitudinal axis and having radially extending blades disposed intermediate said intake and discharge ports and extending over said bottom wall, and means for rotating said impeller.

20. A blender according to claim 19 and characterized further in that said impeller blades have edges adjacent said bottom wall and said impeller blades are inclined forwardly in the direction of impeller rotation from said discharge port upwardly toward said intake port, thereby directing the contents of said blending bowl longitudinally toward said discharge port.

21. A blender according to claim 19 and characterized further in that said impeller blades have edges extending in a configuration complementary to said sloping bottom wall of said blending bowl.

22. A blender according to claim 19 and characterized further in that said sloping bottom wall is frustoconically shaped.

* * * * *